US006386514B1

(12) United States Patent
Ray

(10) Patent No.: US 6,386,514 B1
(45) Date of Patent: May 14, 2002

(54) PORTABLE HITCH-MOUNTED WINCH

(76) Inventor: John D. Ray, 9035 Old Terry Ford Rd., Gainesville, GA (US) 30506

( * ) Notice: Subject to any disclaimer, the term of this patent is extended or adjusted under 35 U.S.C. 154(b) by 0 days.

(21) Appl. No.: 09/611,505

(22) Filed: Jul. 7, 2000

(51) Int. Cl.[7] ..... B66D 1/00
(52) U.S. Cl. ..... 254/323; 280/477
(58) Field of Search ..... 254/323, 328; 224/512, 514, 516, 519, 520; 280/477; 414/539

(56) References Cited

U.S. PATENT DOCUMENTS 3,718,317 A * 2/1973 Hilmer ..... 254/323
3,938,122 A * 2/1976 Mangus ..... 280/477
4,331,323 A * 5/1982 Sekimori et al. ..... 254/323
4,807,899 A * 2/1989 Belcher ..... 280/477
5,048,854 A 9/1991 Clark ..... 280/477
5,072,962 A 12/1991 Webb ..... 280/414.1
5,085,408 A * 2/1992 Norton et al. ..... 280/477
5,128,828 A 7/1992 Bass ..... 439/35
5,522,582 A * 6/1996 Dilks ..... 254/323
5,593,139 A 1/1997 Julian ..... 254/325

* cited by examiner

*Primary Examiner*—Emmanuel M. Marcelo
(74) *Attorney, Agent, or Firm*—Kenneth S. Watkins, Jr.

(57) ABSTRACT

A portable winch for mounting on a hitch component of a vehicle comprises a cable reel retractor portion and a vehicle attachment portion. The vehicle attachment portion may be a ball hitch receptor, or it may comprise a drawbar insertable into the receiver portion of a hitch. An electrical connector insertable in an existing vehicle receptacle provides power to a gear motor of the retractor portion through a extend/retract switch. One embodiment provides electrical power for the gear motor from a cigarette lighter of the vehicle. Another embodiment provides electrical power for the gear motor from a trailer lighting connector of the vehicle.

14 Claims, 5 Drawing Sheets

PORTABLE HITCH-MOUNTED WINCH

BACKGROUND OF THE INVENTION

The present invention relates to vehicle winches, and, more particularly, portable winches easily mounted to a vehicle.

Vehicle-mounted winches provide the ability to perform many useful tasks include loading or unloading trailers, removing debris or obstructions from the roadway, or moving a disabled or stuck vehicle.

Bumper or frame-mounted winches have been available for some time to perform such tasks. Bumper or frame-mounted winches, while often highly capable and rugged, justify their cost and complexity only if the owner anticipates frequent use. Also, the size and appearance of such devices often limits their use to trucks and some utility vehicles.

U.S. Pat. No. 5,072,962 discloses a front or rear mounted portable load-bearing winch. The winch is mounted to a drawbar having a receptacle at one and a stub at the other end and is used to pull loads onto a trailer. U.S. Pat. No. 5,593,139 discloses a device for connecting a winch to a box hitch. A winch connector comprises a winch end and a hitch-connecting end.

While these and other devices provide removable features to vehicle winches, they do not provide features that allow widespread use by the typical vehicle operator.

OBJECTS AND SUMMARY OF THE INVENTION

Therefore an object of the present invention is to provide a light-duty electrical winch which is small, light and attaches quickly to a component of a vehicle hitch.

A further object of the present invention is to provide a hitch-mounted winch which is quickly and easily removed and stored in a vehicle storage space such as a vehicle trunk when not in use.

A further object of the present invention is to provide a winch which is electrically powered from the vehicle electrical system, through existing electrical connectors, without wiring changes or special electrical fittings.

Yet another object of the present invention is to provide a vehicle winch which is low in cost and simple to use without requiring special tools, equipment or operator training.

The vehicle winch of the present invention comprises a retractor portion, a vehicle attachment fitting and an electrical supply system or connector. In the preferred embodiments, the retractor portion comprises a cable assembly retracted and extended by an electric motor-operated cable reel.

In a preferred embodiment, the vehicle attachment fitting is a ball hitch receptor similar to that found on trailers. The ball hitch receptor, mounted to the frame of the winch, accepts the ball hitch of a vehicle and allows quick and easy installation of the winch by a vehicle owner or operator. The ball hitch receptor also allows alignment of the winch frame with the cable of the winch when tensioned.

In the preferred embodiments an electrical plug or connector and electrical cable provides vehicle electrical power to the winch motor. The plug mates with one of several types of electrical receptacles or connectors common to vehicles. In one such embodiment, the electrical plug fits a standard cigarette lighter receptacle or accessory plug receptacle. In the preferred embodiments, a toggle switch, allowing extension and retraction of the load cable is wired into the plug. Such an arrangement allows operation of the winch from the vehicle operator position. An electrical cable wound on a spring-assisted take-up reel provides a simple method to extend and retract the plug from the winch.

Another embodiment utilizes an electrical connector that connects to one of several standard trailer lighting connectors typically found on vehicles with trailer hitches. Winch motor power is supplied from a terminal of the trailer connector which mates with the trailer light connector terminal normally supplying electrical power to the trailer lights when the vehicle parking or headlamps are turned on. Such an embodiment makes power available to the winch motor when the existing vehicle headlamp or parking light switch is turned on. In this manner, the operator may energize the winch motor to retract the load cable from the vehicle operator's position by operating the appropriate existing lighting switch.

Still another embodiment utilizes a separate battery attached to the winch to provide electrical power. The battery may be a rechargeable type, or, it may be one-time use or emergency use battery.

In still other embodiments, a drawbar forms a frame of the winch and provides a vehicle attachment fitting. The drawbar fits the receiver portion of a vehicle hitch, allowing quick and simple installation. A toggle switch on the winch provides local extension and retraction of the cable.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a portable winch mountable on a vehicle.

Figure 1A:
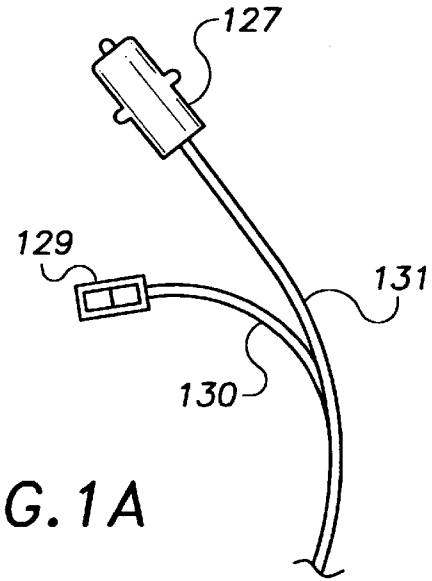
FIG. 1A is an alternative embodiment of the electrical power supply of the embodiment of FIG. 1 comprising an electrical connector and separate remote switch.
Figure 1:
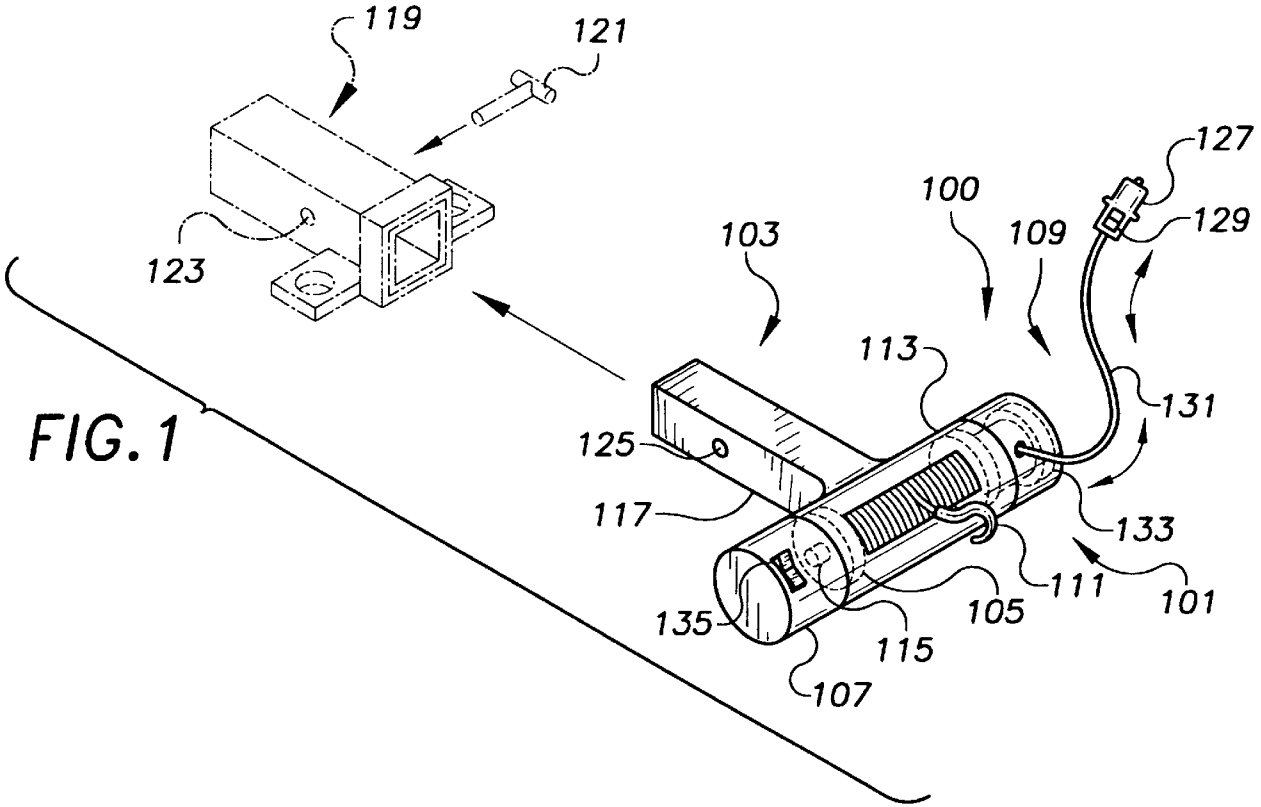
FIG. 1 is a perspective drawing of an embodiment of the winch having a retractor portion attached to a vehicle attachment portion comprising a hitch drawbar engageable to a receiver of a vehicle hitch, a gear motor of the receiver portion powered from the vehicle electrical system by a electrical power supply comprising an electrical connector and integral switch.

FIG. 1 is a perspective drawing of embodiment 100 of a portable winch apparatus for vehicles comprising a retractor portion 101 and a vehicle attachment fitting 103. Retractor portion 101 consists of a cable reel 105, electric gear motor 107 and electrical power supply 109. Cable and hook assembly 111 is wound around cable reel 105 and supported by frame 113 and bearings (not shown). Gear motor 107 rotates cable reel 105 in either direction by shaft coupling 115. In the preferred embodiments, gear motor 107 is an integral unit. In other embodiments, gear motor 107 comprises a separate electric motor and a separate gear reducer mechanically coupled. In the preferred embodiments, gear motor 107 comprises a brake motor.

Vehicle attachment fitting 103 comprises a vehicle hitch drawbar 117 fastened to retractor portion 101 by welding or mechanical fasteners such as bolts, screws, rivets or mechanical joints. Drawbar 117 is dimensioned to fit into a standard vehicle hitch receiver 119, shown in phantom lines. Retaining pin 121, inserted into locking hole 123 of receiver 119 and matching locking hole 125 of draw bar 117, retains drawbar 117 in receiver 119.

Electrical power supply 109 provides power to gear motor 107 and comprises winch power supply connector 127, remote switch 129, winch power cable 131 and cable take-up reel 133. In the preferred embodiments, winch power supply connector 127 is an accessory plug dimensioned to fit in a complementary connector of the vehicle such as a cigarette lighter receptacle or accessory receptacle. In the preferred embodiments, remote switch 129 is a rocker type switch mounted in connector 127 providing reversible-polarity power to gear motor 107 to retract or extend cable and hook assembly 111. Local switch 135, mounted on retractor portion 101 provides local control of retraction and extension of cable and hook assembly 111. Cable take-up reel 133 may be a spring-retracted reel as known in the art. In other embodiments, reel 133 is omitted.

FIG. 1A shows an alternative embodiment of winch power connector 127 and separate remote switch 129. Switch cable 130 connects remote switch 129 to winch power cable 131.

Figure 2:
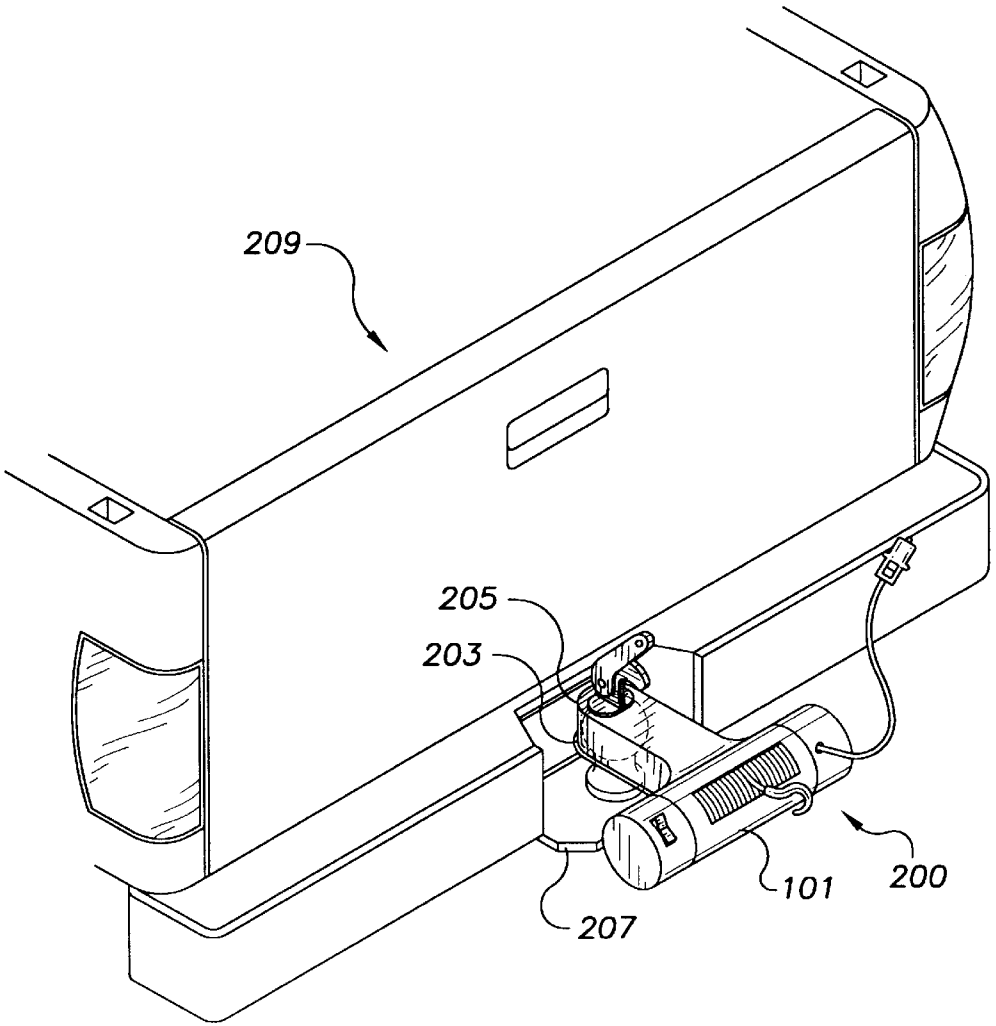
FIG. 2 is a perspective drawing of an embodiment of the hitch-mounted winch having a ball hitch receptor engageable to a ball hitch of a vehicle.

FIG. 2 is a perspective drawing of embodiment 200 of a portable winch apparatus for vehicles comprising retractor portion 101 and a vehicle attachment fitting 203. Retractor portion 101 consists of a cable reel 105, electric gear motor 107, electric power supply 109, and cable and reel assembly 111 as described in FIG. 1.

Figure 3:
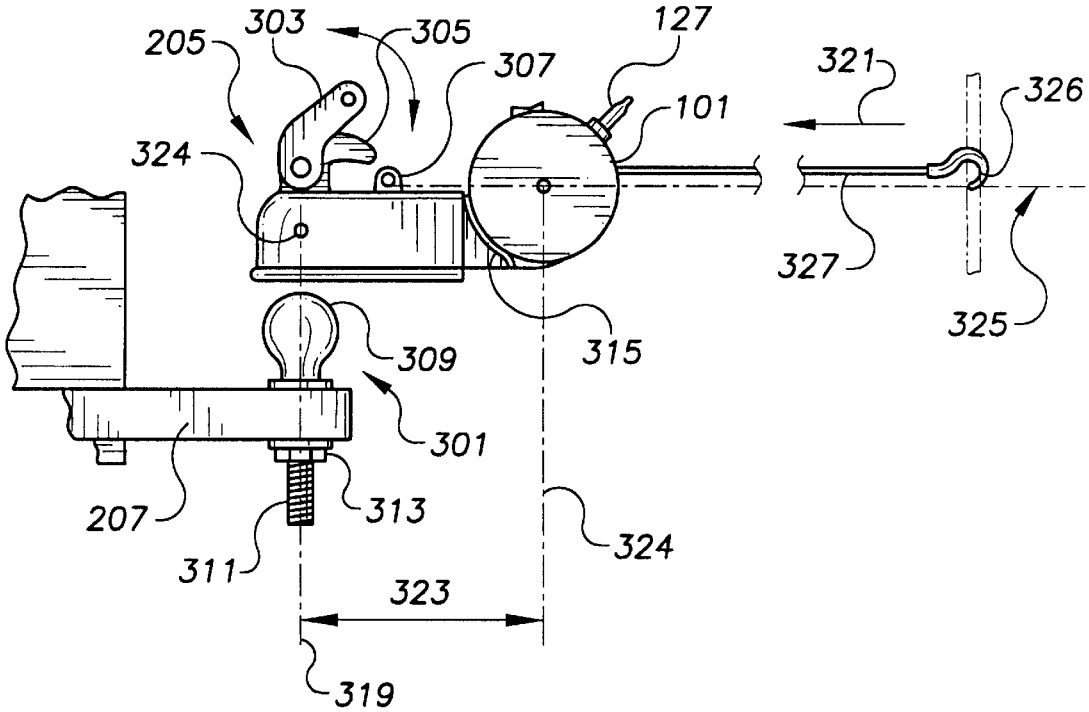
FIG. 3 is an elevation drawing of the winch apparatus of FIG. 2 showing the ball hitch receptor aligned with the vehicle ball hitch, and an offset between the cable reel and the centerline of the ball hitch receptor which provides alignment of a longitudinal centerline of the winch with the tensioned cable of the winch.

Vehicle attachment fitting 203 comprises a ball hitch receptor 205, better shown in FIG. 3. Ball hitch receptor 205 mates with ball hitch 301 of FIG. 3 mounted to a structural member of a vehicle such as bumper 207 of vehicle 209.

FIG. 3 is an elevation drawing of the winch apparatus of FIG. 2 showing ball hitch receptor 205 and ball hitch 301. Ball hitch receptor 205 and ball hitch 301 are known in the art and comprise, for example, ball engagement lever 303, latch lever 305, and lock aperture 307. Ball hitch 301 comprises ball 309, ball shaft 311, and ball attachment nut 313.

Ball hitch receptor 205 is fixed to retractor portion 101 by welds 315 or mechanical fasteners. Winch power connector 127 is shown in its retracted position.

Offset of the retractor portion with respect to the ball hitch receptor allows rotation of retractor portion 101 in horizontal and vertical planes. The ball hitch receptor centerline 319 is offset from reel centerline 324 in retraction direction 321 by offset distance 323. Retraction direction 321 is generally perpendicular to the reel axis and parallel to a longitudinal centerline 325 of the apparatus.

Offset 323 ensures that retractor portion 101 pivots about ball center point 324 to align the longitudinal centerline 325 of the winch apparatus with the load point 326 and tensioned cable 327. In the preferred embodiments, offset 323 is a horizontal offset of at least two inches, and in the more preferred embodiments, offset 323 is at least four inches. In the most preferred embodiments, offset 323 is at least 6 inches to provide higher alignment moments to the apparatus and to reduce effects of transverse cable movement during winding on the cable.

Figure 4:
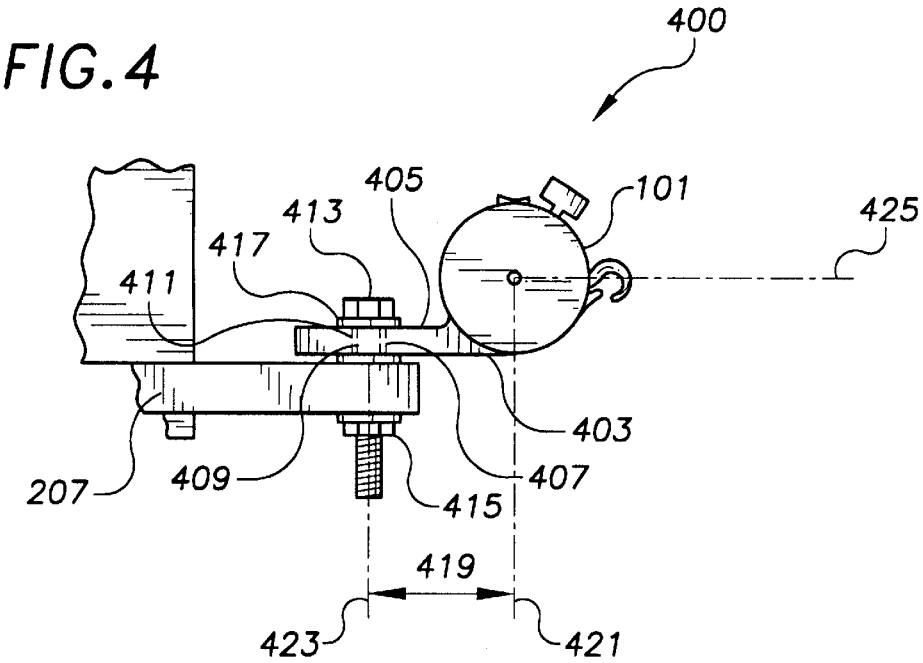
FIG. 4 is an elevation drawing of an alternative embodiment of the hitch-mounted winch having a pivoting bar attached to the retractor portion, the pivoting bar rotatably attached to an aperture on the vehicle bumper.

FIG. 4 is an elevation drawing of embodiment 400 of a portable winch apparatus for vehicles comprising retractor portion 101 and a vehicle attachment fitting 403. Retractor portion 101 consists of a cable reel 105, electric gear motor 107, electric power source 109, and cable and reel assembly 111 as described in the embodiment of FIG. 1.

Vehicle attachment fitting 403 comprises attachment bar 405 and pivot mount 407. Pivot mount 407 may comprise a simple aperture, or in the preferred embodiments, pivot mount 407 comprises a sleeve bushing 409 assembled in aperture 411 of attachment bar 405. Pivot bolt 413 pivotally secures attachment bar 405 to bumper 207. Attachment nut 415 secures pivot bolt 413. Flanges 417 of pivot bushing 409 take axial loads of pivot bolt 405 and nut 415 and allow free pivoting of attachment bar 405 in a horizontal plane about pivot mount 407.

Offset 419 between reel centerline 421 and pivot mount centerline 423 allows pivoting of retractor portion 101 about pivot mount centerline 423 to align longitudinal centerline 425 of retractor portion 101 to the load and with the cable when tensioned as shown in FIG. 3. Offset 419 distances are similar to those of FIG. 3. This embodiment allows attachment to a vehicle without a mounted hitch.

Figure 5A:
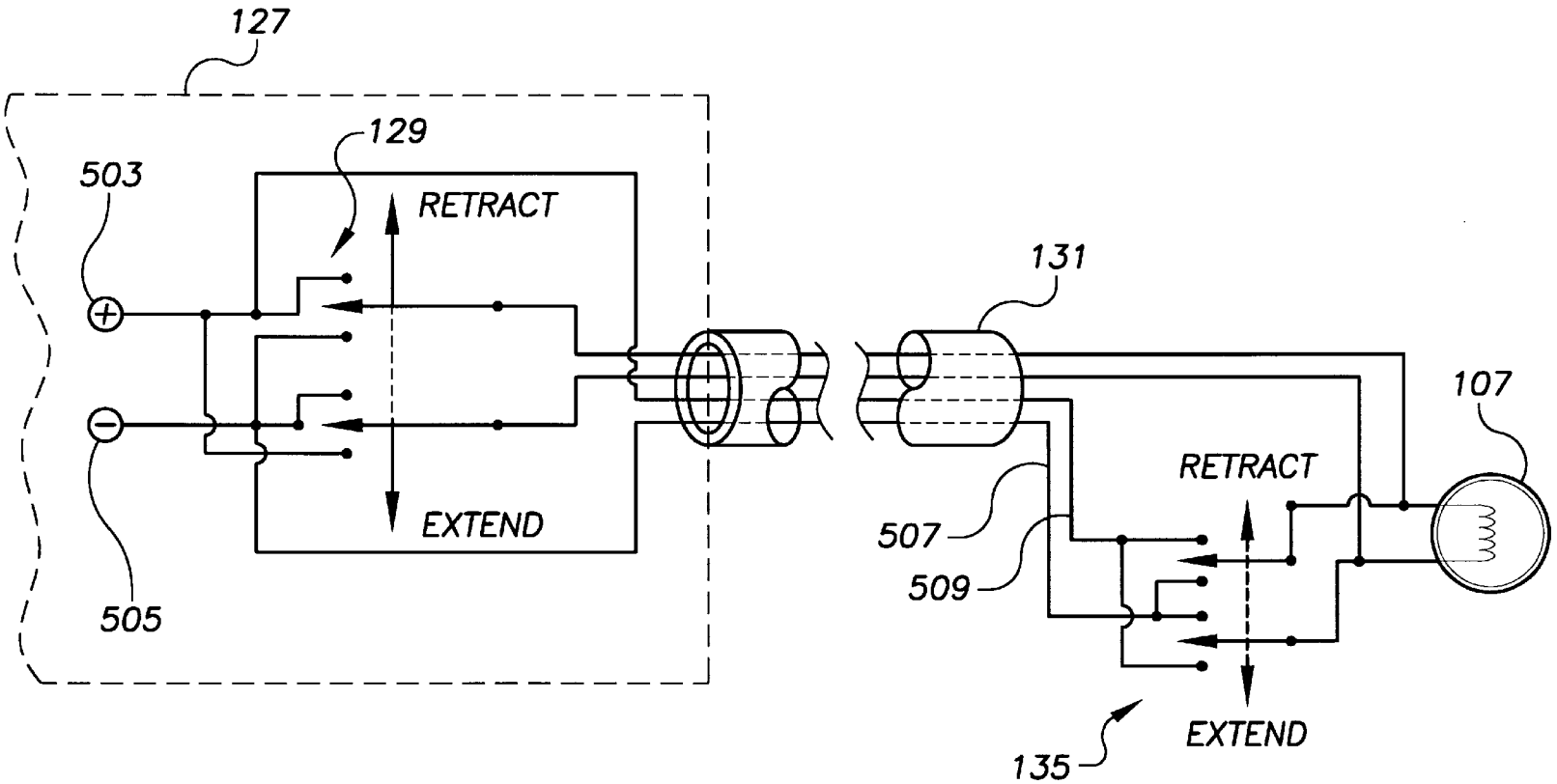
FIG. 5A is a schematic diagram of the electrical power supply having a power connector with integral remote extend/retract switch, and an electrical cable connecting to the gear motor through a local extend/retract switch.

FIG. 5A is a schematic diagram of a preferred embodiment of electrical power supply wiring of the apparatus of FIGS. 1–4. Winch power connector 127 is an electrical plug insertable into the cigarette lighter or accessory receptacle of a vehicle. Positive potential and current from the vehicle electrical system is available at 503 in the plug when inserted into the vehicle receptacle and negative or ground potential from the vehicle electrical system is available at 505 in the plug. Remote switch 129 such as a double-pole, double-throw momentary rocker switch provides reversible polarity power to gear motor 107 via retractable cable 131. Local switch 135, mounted on the retractor portion 101 of FIG. 1 provides reversible polarity power via conductors 507 and 509 of cable 131. In this manner, either remote switch 129 or local switch 135 provides power to extend or retract the cable assembly of the portable winch apparatus.

Cable take-up reel 133 of retractor portion 101 allows the operator to extend cable connector 127 in a convenient manner to a receptacle on the vehicle. Local switch 135 allows the operator to extend and retract cable and hook assembly 111 to facilitate connection to the desired load. Remote switch 129 allows the operator to operate the portable winch in the retracted or extended direction from the vicinity of the receptacle in the vehicle. Normally a receptacle is located within reach of the driver in the driver's position. In an alternative embodiment, remote switch 129 is separate from connector 127 and connected by a cable as shown in FIG. 1A. A separate remote switch 129 allows access to the switch from the driver's position even if the receptacle is not within reach of the driver's position.

Figures 5B, 5C:
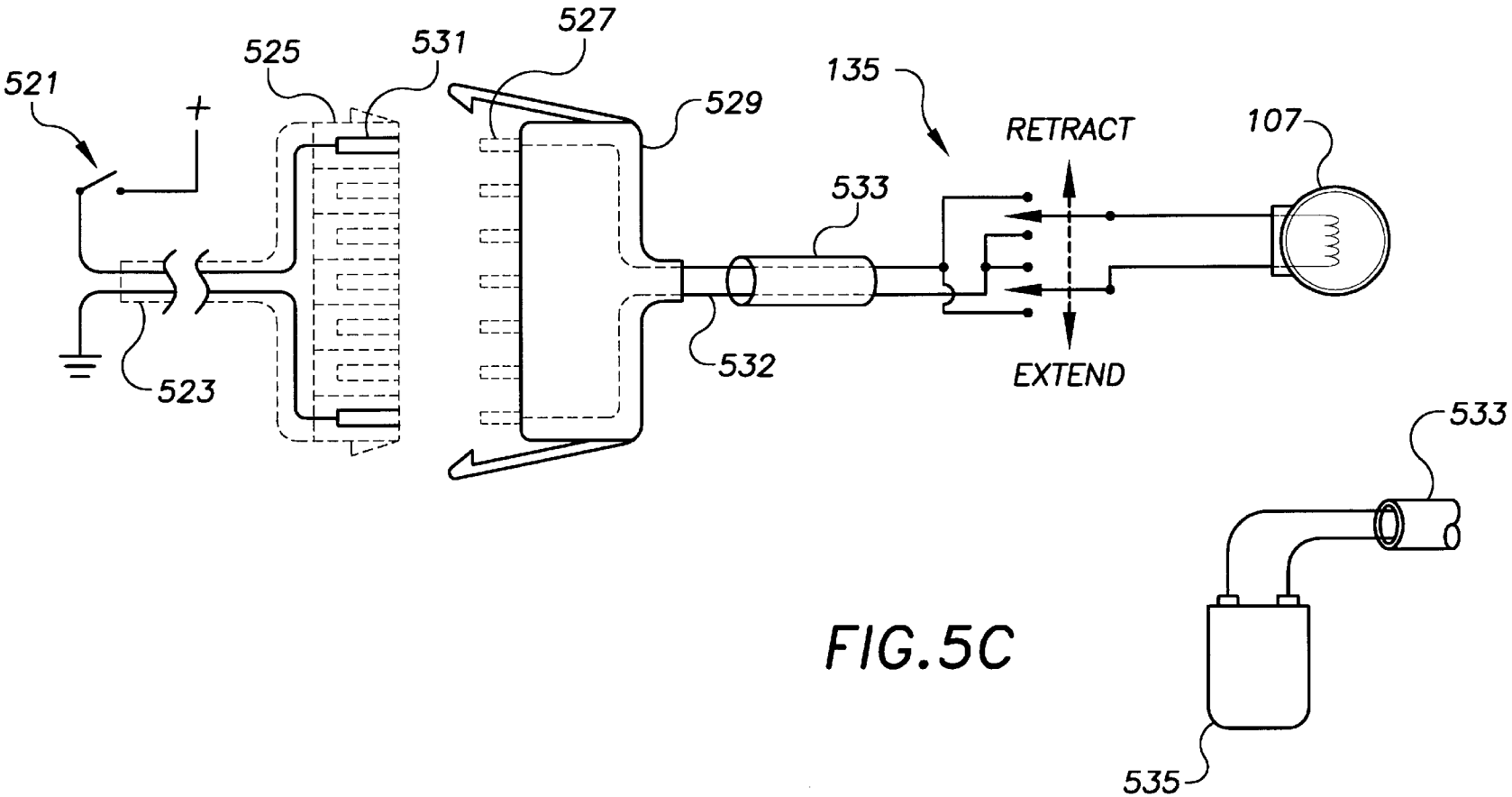
FIG. 5B is a schematic diagram of an embodiment of the electrical power supply comprising a winch power connector with a terminal making electrical contact with the trailer lighting terminal of a trailer lighting connector energized by a parking light switch in the vehicle, the winch power connector connected to the gear motor by a cable and local switch.
FIG. 5C is an alternative embodiment of the electrical power supply comprising a portable winch battery.

FIG. 5B is a schematic diagram of alternative electrical power supply wiring of the apparatus of FIGS. 1–4. In this embodiment, the vehicle electrical system supplies positive potential and current through parking light switch 521, trailer lighting cable 523 and trailer lighting connector 525. Winch supply terminal 527 of winch connector 529 makes electrical contact with the trailer tail light terminal 531 of the trailer lighting connector 525. Winch supply cable 533 supplies current from winch supply terminal 527 to gear motor 107 via switch 135. Switch 135 maybe a local extend/retract switch as in FIG. 5A, or it may be remotely connected to the apparatus by a connecting switch cable.

Conductor 532 of cable 533 provides a ground path between the vehicle and gear motor 107. In other embodiments, winch connector 529 receives current through other vehicle-activated switches providing power to trailer lighting connector 525 such as turn signal switches, back-up light switch, or brake light switch. Placement of terminal 527 may be modified to provide power through an alternative vehicle-activated switch.

In another preferred embodiment, winch connector 529 is replaced by a separate electrical power source such as a battery 535 of FIG. 5C. Battery 535 may be fixed to, and self-contained with, the winch apparatus. Battery 535 may be a rechargeable battery, or, it may comprise a high-capacity non-rechargeable battery.

Still other electrical power supply variations are possible within the spirit and scope of this invention including use of extension cables between switches 129 and 135 and the respective components of the winch apparatus to provide improved convenience to the operator.

Accordingly the reader will see that the PORTABLE HITCH-MOUNTED WINCH provides a compact winch for use on a vehicle. The apparatus provides the following additional advantages:

The winch requires no vehicle modifications and may be quickly mounted by the vehicle operator without special tools or equipment;

Existing vehicle electrical connectors or sockets provide power to the portable winch;

Vehicle-activated switches provide control of the winch in the driving position; and The winch apparatus is simple and low in cost.

Although the description above contains many specifications, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A portable winch apparatus for attachment to a ball hitch of a vehicle, the apparatus comprising:

a retractor portion comprising a cable reel and an electric motor operably attached to the cable reel for retracting and extending a cable wound about the cable reel;

a ball hitch receptor fixed to the retractor portion, the ball hitch receptor engageable with the ball hitch of the vehicle and;

a battery attached to the retractor portion, the battery operably connected to the electric motor through a switch.

2. The apparatus of claim 1 wherein the retractor portion comprises a horizontal offset from the cable reel in the retraction direction whereby a longitudinal axis of the apparatus aligns with an extended cable length when the ball hitch receptor is engaged to the ball hitch of a vehicle and the extended cable length is tensioned.

3. A portable winch apparatus for attachment to a vehicle, the apparatus comprising:

a retractor portion comprising a cable reel and an electric motor operably attached to the cable reel for retracting and extending a cable wound about the cable reel;

a vehicle attachment fitting fixed to the retractor portion, the vehicle attachment fitting attachable to a complementary fitting on the vehicle;

an electrical plug connected to the electric motor by an electric cable; and an electric cable wind-up reel attached to the retractor portion, the electric cable operably engaged with the wind-up reel whereby the electric cable is extendable and retractable onto the wind-up reel.

4. The apparatus of claim 3 wherein the plug is of predetermined dimensions to fit a cigarette lighter receptacle of the vehicle.

5. The apparatus of claim 3 wherein the plug is of predetermined dimensions to fit an electrical accessory receptacle of the vehicle.

6. The apparatus of claim 3 wherein the plug is of predetermined dimensions to fit a trailer lighting receptacle of the vehicle.

7. The apparatus of claim 3 wherein the vehicle attachment fitting is a ball hitch receptor.

8. The apparatus of claim 3 wherein the vehicle attachment fitting is a hitch drawbar of predetermined dimensions to attach to a standard hitch drawbar receiver on the vehicle.

9. The apparatus of claim 3 wherein the vehicle attachment fitting comprises a bar with a first aperture and a pivot bolt, the pivot bolt of predetermined dimensions for insertion into the first aperture and a complementary aperture on the vehicle.

10. The apparatus of claim 9 wherein the first aperture is in a pivot bushing fixed to the vehicle attachment fitting.

11. A portable winch apparatus for attachment to a vehicle, the apparatus comprising:

a retractor portion comprising a cable reel and an electric motor operably attached to the cable reel for retracting and extending a cable wound about the cable reel;

a vehicle attachment fitting fixed to the retractor portion, the vehicle attachment fitting attachable to a complementary fitting on the vehicle; and an electrical supply connector electrically connected to the electric motor, the electrical supply connector of predetermined dimensions to fit a trailer lighting connector attached to the vehicle wherein the electric motor is energized by operation of a lighting switch in the vehicle.

12. The winch apparatus of claim 11 comprising a direction switch electrically connected to the motor for selecting the direction of cable reel motion when energized by the lighting switch in a vehicle.

13. The winch apparatus of claim 11 comprising an extension switch electrically connected to the motor for extending the cable of the winch.

14. The winch of claim 11 wherein the vehicle attachment fitting is a ball hitch receptor fitting.

* * * * *